US006757921B2

(12) United States Patent
Esche

(10) Patent No.: US 6,757,921 B2
(45) Date of Patent: Jul. 6, 2004

(54) PULL-OUT FAUCET

(75) Inventor: John C. Esche, Kohler, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/196,693

(22) Filed: Jul. 16, 2002

(65) Prior Publication Data

US 2004/0010848 A1 Jan. 22, 2004

(51) Int. Cl.[7] ..... E03C 1/04

(52) U.S. Cl. ..... 4/677; 4/678; 239/588; 137/625.4

(58) Field of Search ..... 4/677, 678; 239/588, 239/445, 449; 137/801, 625.4, 625.41

(56) References Cited

U.S. PATENT DOCUMENTS

| | | | | |
|---|---|---|---|---|
| 3,476,149 A | * | 11/1969 | Dornaus Reinert | 137/625.4 |
| 3,684,190 A | | 8/1972 | Bietcher et al. | |
| 5,073,991 A | * | 12/1991 | Marty | 4/678 |
| 5,213,268 A | | 5/1993 | Gnauert et al. | |
| 5,546,978 A | | 8/1996 | Parker | |
| 5,558,128 A | * | 9/1996 | Pawelzik et al. | 4/677 X |
| 5,657,791 A | * | 8/1997 | Graber | 137/625.41 |
| 5,755,258 A | * | 5/1998 | Pawelzik et al. | 137/625.4 X |
| 5,758,690 A | | 6/1998 | Humpert et al. | |
| 6,106,027 A | | 8/2000 | Mulvey et al. | |
| 6,154,897 A | * | 12/2000 | Paini | 4/677 |
| 6,199,586 B1 | * | 3/2001 | Pawelzik et al. | 137/625.4 X |
| 6,370,713 B2 | | 4/2002 | Bosio | |

OTHER PUBLICATIONS

Bach, "Solo Minuet Entertainment Faucet" literature, Apr. 2001, 5 pgs.*

Pages 3–8 and 10–14 of an undated brochure entitled Bach Modern Classics depicting the Solo and Solo Premier faucets, prior art status unknown. Applicant also advises that as can be see from the enclosed Jul. 5, 2002 web site excerpt, Bach has included on its current web site an indication that it had introduced the Solo and Solo Premier as early as Apr. of 2001.

* cited by examiner

*Primary Examiner*—Robert M. Fetsuga
(74) *Attorney, Agent, or Firm*—Quarles & Brady LLP

(57) ABSTRACT

A pull-out faucet has a hollow faucet body with open top and bottom ends and a cylindrical (laterally extending) side opening. A hollow, cane-shaped spout mounts to the top end and seats a spray head at one end. A separate valve block mounts in the housing through the side opening and connects to a mixing valve cartridge lying adjacent thereto on a lateral side. Water supply hoses snap into inlet passages of the valve. One end of a counterweighted spray hose assembly snaps into an outlet passage of the valve block and the other end connects to the spray head. The spray head can be extended from the spout and then retracted. A method of assembling the hoses and valve assembly into the hollow faucet body through the side opening is also disclosed.

11 Claims, 6 Drawing Sheets

FIG. 5
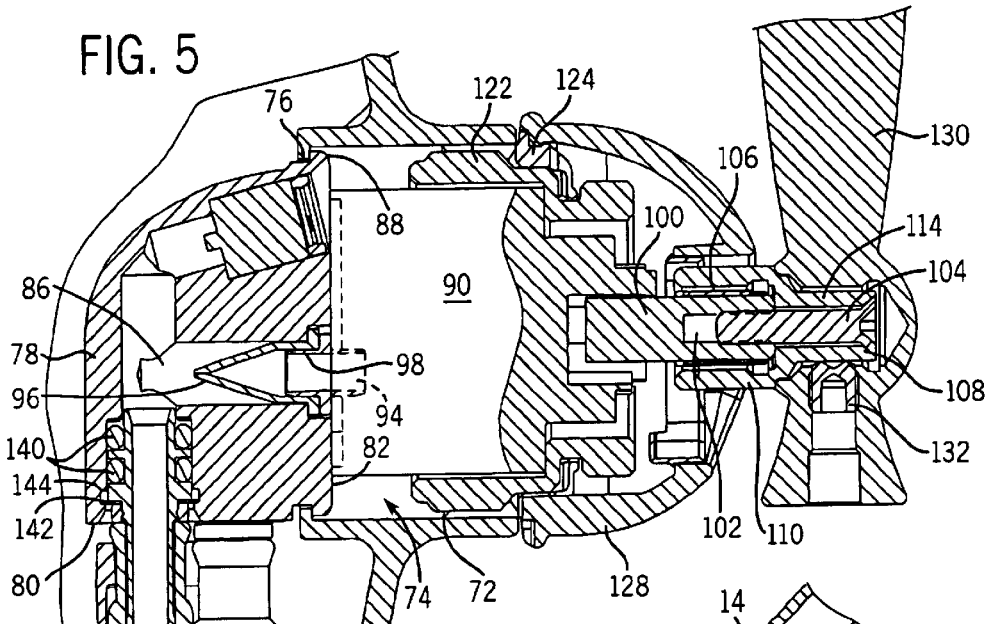
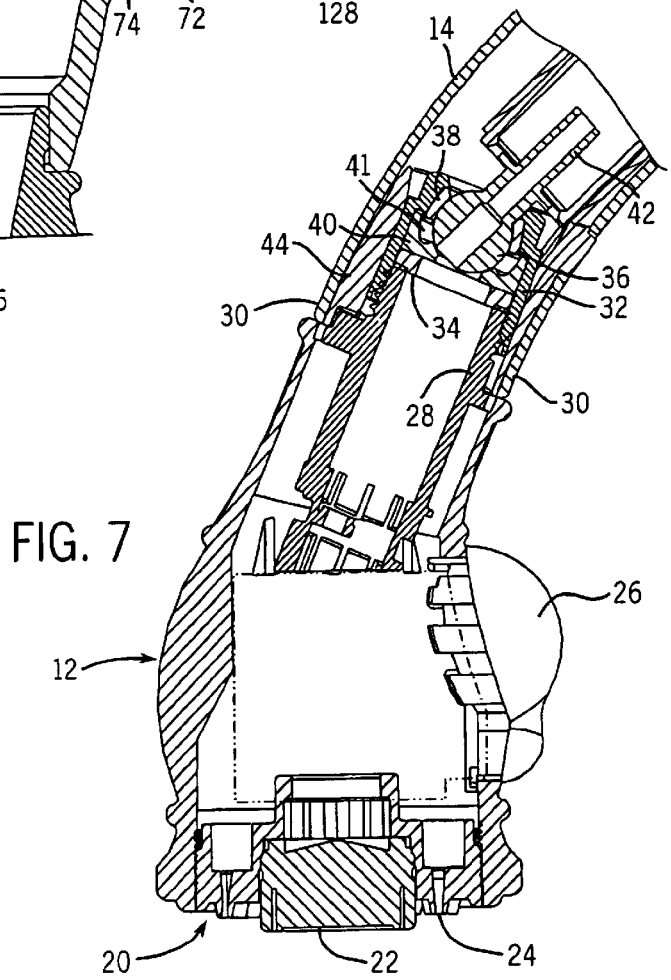
FIG. 7

PULL-OUT FAUCET

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to faucets, and in particular to faucets with pull-out type spray heads.

Conventional faucets have a faucet body, one or more flow control/mixing valves, one or more control handles, and a spout. The spout acts a conduit for expelling water that has passed through the valve(s), in which case the outflow is either fixed to begin at a single point, or in the case of a pivotal spout is limited to begin over a range of a prescribed horizontal arc.

Thus, faucets have conventionally been provided with separate stand-alone hand-held sprayers to provide the user with more flexibility with regard to the direction and point that outflow begins, particularly to facilitate spraying down dishware. These sprayers have a flexible hose attached to the spray head allowing the spray head to be pulled from a mount and moved about as needed. However, these faucets require extra room on the counter top for the sprayer mounting, as well as a separate hole through the counter top.

As an alternative, faucets with pull-out spray heads projecting from the main faucet body have been developed. See generally U.S. Pat. Nos. 5,213,268; 5,546,978; 5,758,690 and 6,370,713. The first two of these references have the sprayer unit extend from the side of the faucet body, and the latter two have the sprayer unit extend from the upper end of the faucet body.

Assembly of such pull-out faucets is usually more complicated then conventional faucets due to the added spray hose and its coupling to the water supply lines. The spray hose must run through the body of the faucet near the valve assembly, which typically includes a large number of components. Also, separate fasteners are ordinarily needed to install the valve assembly in the faucet body.

This can significantly increase the cost of production of the faucet, and in some cases the shipping weight of the product.

A need therefore exists for an improved pullout type faucet, particularly one that is easier to assemble and is relative lightweight.

SUMMARY OF THE INVENTION

In one aspect the invention provides a pull-out faucet. It has a hollow body defining a longitudinal cavity opening at a bottom end, at a top end and at an internally threaded side; a spout having proximal and distal ends and defining a passageway there between, the proximal end being mounted to the top end of the body; and a spray head having discharge orifices and being positioned adjacent the distal end of the spout when in a retracted position.

There is also a valve block that is not integral with the hollow body, is disposed in the cavity, has two inlet passages, has an outlet passage, and has a side face; a mixing valve cartridge having an end that is positioned adjacent the side face of the valve block and having an opposite end; and a control stem projecting from the opposite end of the cartridge.

Preferably, the side opening of the body is defined by a laterally extending cylindrical section having an inner end inside the cavity and an outer end outside the cavity. The mixing valve cartridge and valve block are secured to the body by tightening an externally threaded valve bonnet into the side opening so as to press them together and force a peripheral flange on the valve block to seat against an inwardly directed lip of the body.

Further, water supply hoses are coupled to the valve block inlet passages, an outlet hose has a first end coupled to the valve block outlet passage and a second end coupled to the spray head, and the outlet hose is of a suitable size to slide within the spout passageway to permit the spray head to be pulled from the spout to an extended position. There is also a handle coupled to the control stem for operating the valve.

In preferred forms there is a handle bonnet mounted about the control stem to the outer end of the cylindrical section to rotate with the control stem, and the valve block inlet passages open in the direction of the bottom opening in the body. One or more of the hoses can be coupled to the valve block by a push-in connection via a washer projection, the spray head can be coupled to the spray hose by a ball and socket connection, and there can also be a counterweight mounted to the spray hose to bias the spray head toward the distal end of the spout.

In another aspect the invention provides a method of assembling a pull-out faucet. One provides a faucet body defining a longitudinal cavity opening at bottom and top ends and at an internally threaded side; assembles to a valve block hot and cold water supply hoses so that they extend from inlet passages of the valve block; and assembles to the valve block an outlet hose so that it extends from an outlet passage of the valve block. One then inserts the hoses through the body side opening, then feeding them down through the bottom opening, and inserts the valve block into the side opening.

One then positions a mixing valve cartridge against a side face of the valve block so that corresponding ports of the mixing valve cartridge align with respective inlet and outlet passages of the valve block. Then one threads a valve bonnet into the side opening to secures the valve block and cartridge in the body. One then feeds a first end of the outlet hose up through the body bottom opening, through the cavity, through the top opening of the body, and into a spout attachable to the top end of the body. Then, one connects a spray head to a second end of the outlet hose.

In preferred forms the method includes mounting a handle bonnet about an end of the mixing valve cartridge, and mounting a counterweight to the outlet hose to bias the spray head towards a distal end of the spout.

The invention thus provides a faucet that is particularly suitable for kitchen sinks (albeit also useful for other plumbing applications such as bathtubs), where the spray head is connected to water supply lines by a flexible hose disposed inside the faucet. This allows the faucet to look and operate like a conventional solid body faucet and also allow the spray head to be pulled out from the faucet to change the location and reach of the spray head.

The faucet preferably has a hollow body with a cylindrical opening in which is disposed a valve block and a one-piece mixing valve cartridge lying laterally so that its valve stem extends out from one side of the faucet for attaching a handle. The threaded side opening and valve bonnet permit easy installation of the valve assembly (and hoses), while minimizing components and the weight of the faucet.

These and still other advantages of the invention will be apparent from the detailed description and drawings. What follows is a preferred embodiment of the present invention. To assess the full scope of the invention the claims should be looked to as the preferred embodiment is not intended as the only embodiment within the scope of the invention.

BRIEF DESCRIPTION OF THE DRAWINGS

FIG. 5 is a cross-sectional view taken along line 5—5 of FIG. 1;

FIG. 7 is an enlarged vertical cross-sectional view of the spray head portion of the faucet;

DETAILED DESCRIPTION OF THE PREFERRED EMBODIMENT

Figure 1:
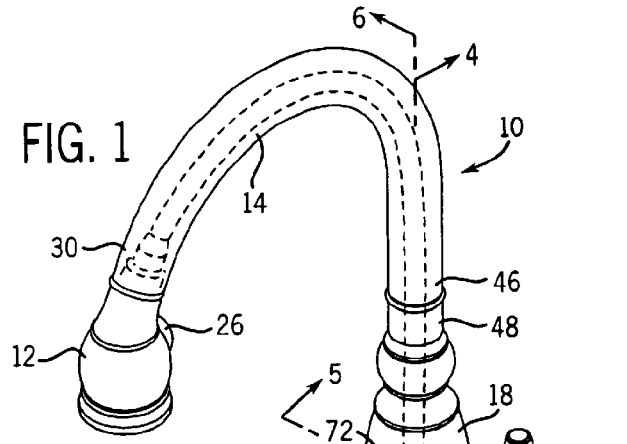
FIG. 1 is front, right perspective view of a pull-out faucet in accordance with the present invention.
Figure 2:
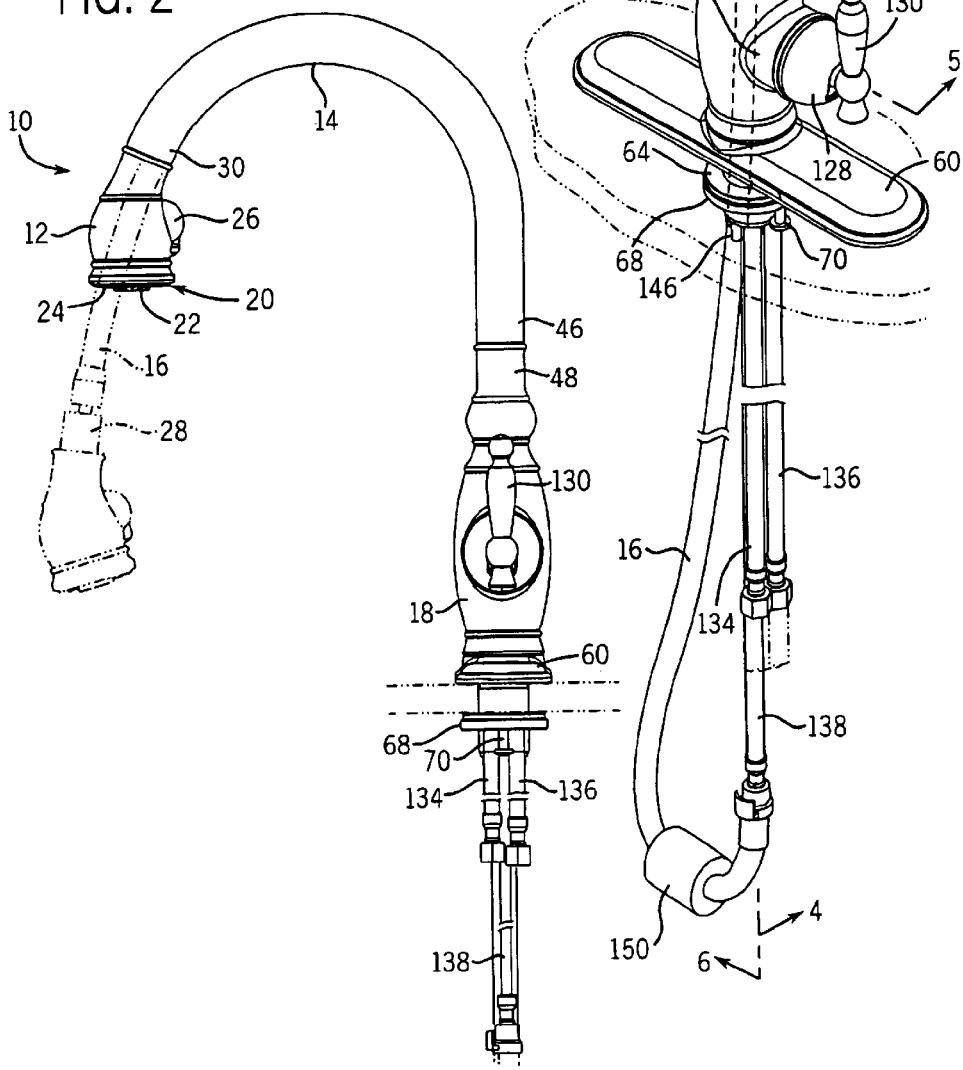
FIG. 2 is a side elevational view thereof, albeit showing in phantom an alternative position for the spray head.
Figure 3:
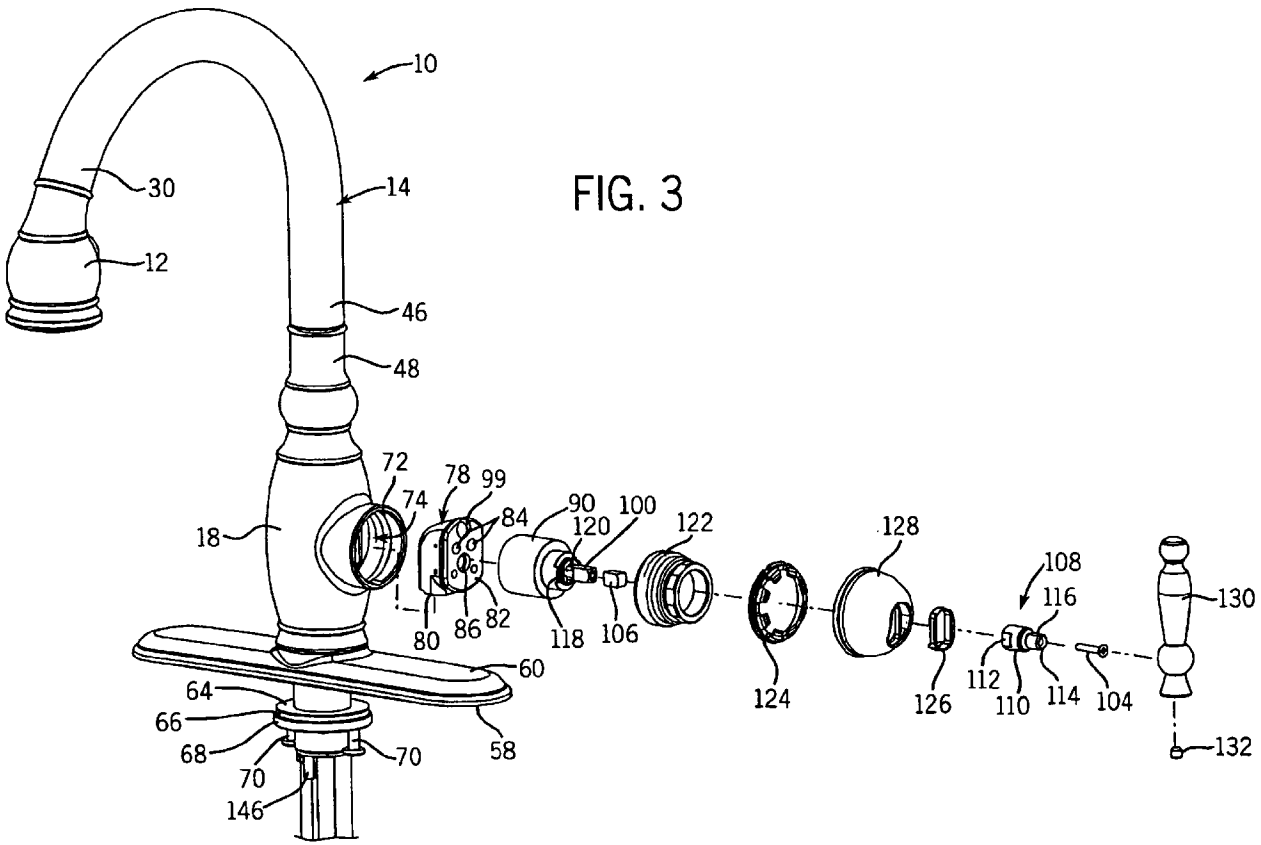
FIG. 3 is an exploded front, right perspective view of the faucet.

The main structure of the faucet 10 includes the spray head 12, the spout 14 and a body 18. FIG. 1 shows a preferred version of the pull-out faucet. FIG. 2 illustrates that the faucet's spray head 12 can be pulled, in this case downwardly at first, from a retracted position (shown in full) to an extended position (shown in phantom). The faucet can thus be used as a conventional faucet in which the spray head is mounted to the spout 14, or with the spray head separated from the spout to be moved freely, limited only by the length of the attached spray hose 16.

The internal components of the spray head can be as disclosed in U.S. Pat. No. 6,370,713, hereby incorporated by reference as though fully disclosed herein, and are commercially available from AMFAG S.p.A. of Castelgoffredo, Italy. Basically, the spray head has a face 20 with central outlet 22 and a ring of discharge nozzles 24 providing a shower-like spray pattern when a thumb-operated button 26 is depressed to divert flow from the central outlet. The spray head may also include an aerator, a flow restrictor and a check valve.

The spray head has a connection extension 28 that fits into a distal end 30 of the spout. As shown in FIG. 7, the connection end screws into a threaded receptacle 32 containing a screen 34 and a ball 36 disposed between a hose retainer 38 and a retainer 40. There is an o-ring 41 between the retainer and the ball. The ball has a through opening in communication with a hollow stud 42 fixed to an end of the spray hose. This arrangement provides a swivel joint between the spray hose and the spray head when it is pulled out from the spout. The receptacle seats within a plastic insert 44 in the distal end of the spout when retracted. A shoulder of the spray head abuts the distal end of the spout to stop retraction.

Referring now to FIGS. 1, 2 and 4–6 the spout is a hollow, tubular cane-shape brass member defining a passageway for the spray/outlet hose between the distal end 30 and a proximal end 46. The spout begins straight at the proximal end and then sweeps an arc of approximately 160 degrees such that the distal end is facing in a largely downward direction. The proximal end pivotally mounts to a top end 48 of the body. A plastic ribbed bushing 50 fits between the two components to facilitate relative rotation.

Figure 4:
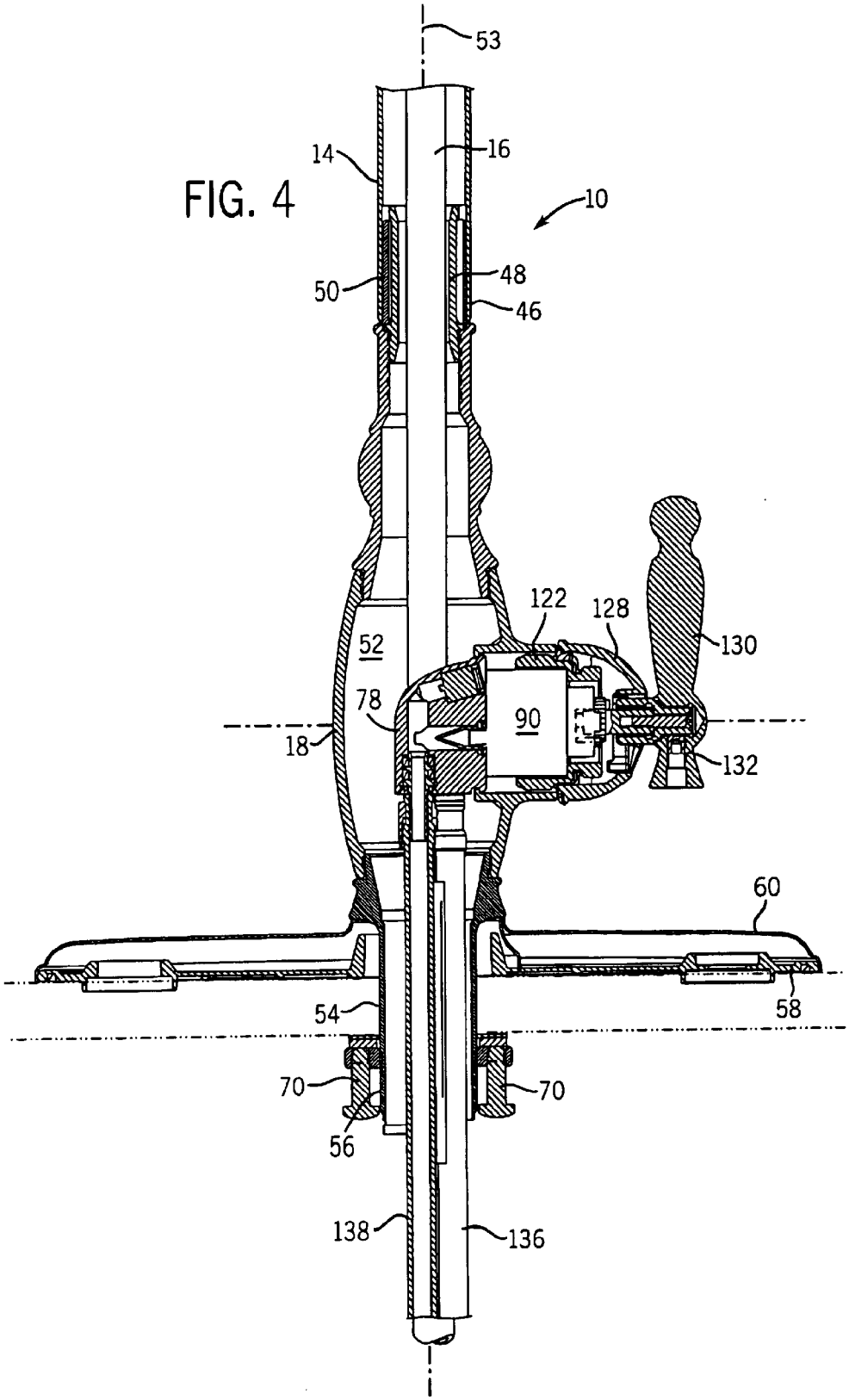
FIG. 4 is a cross-sectional view taken along line 4—4 of FIG. 1.
Figure 6:
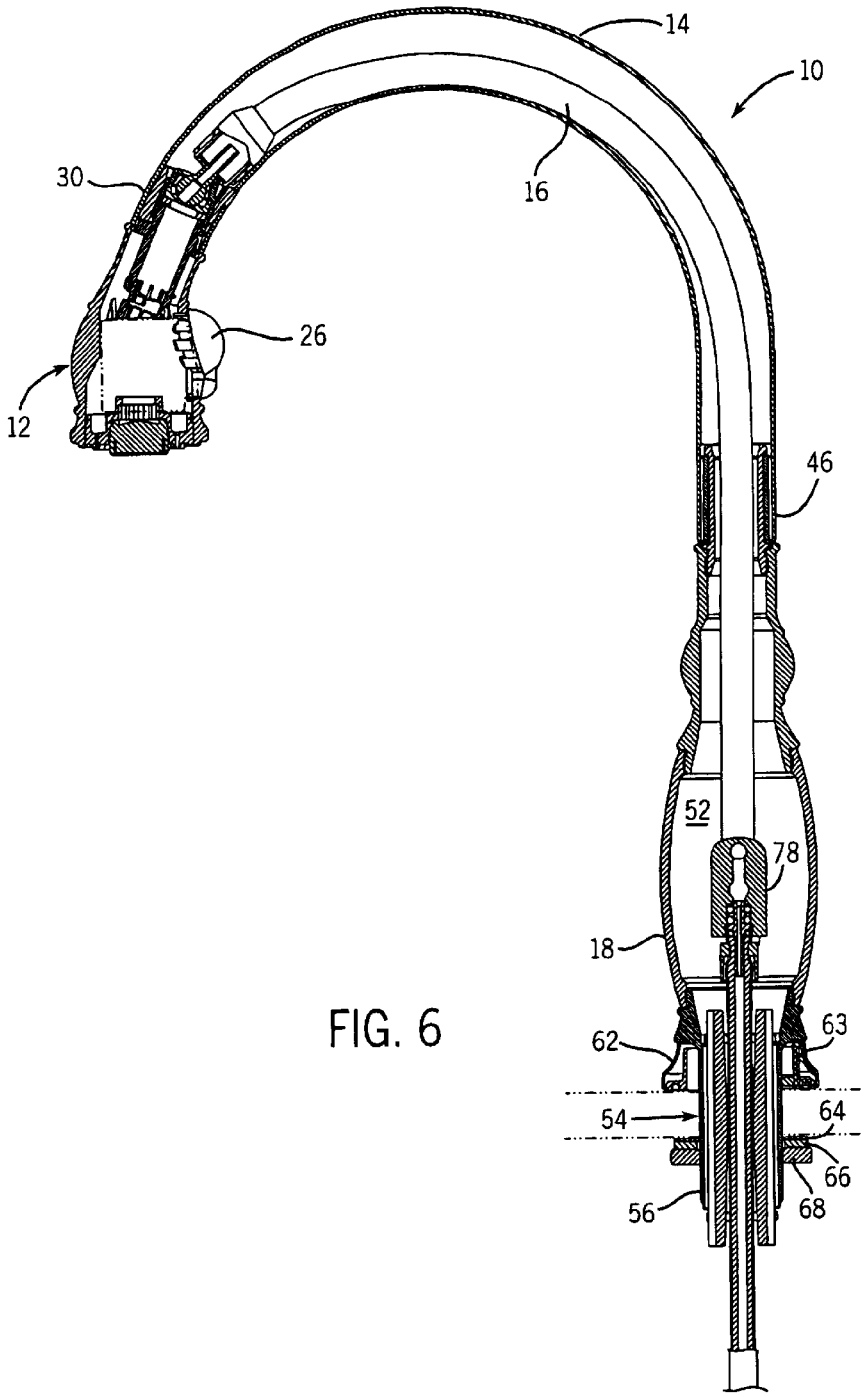
FIG. 6 is a cross-sectional view taken along line 6—6 of FIG. 1.
Figures 8, 9:
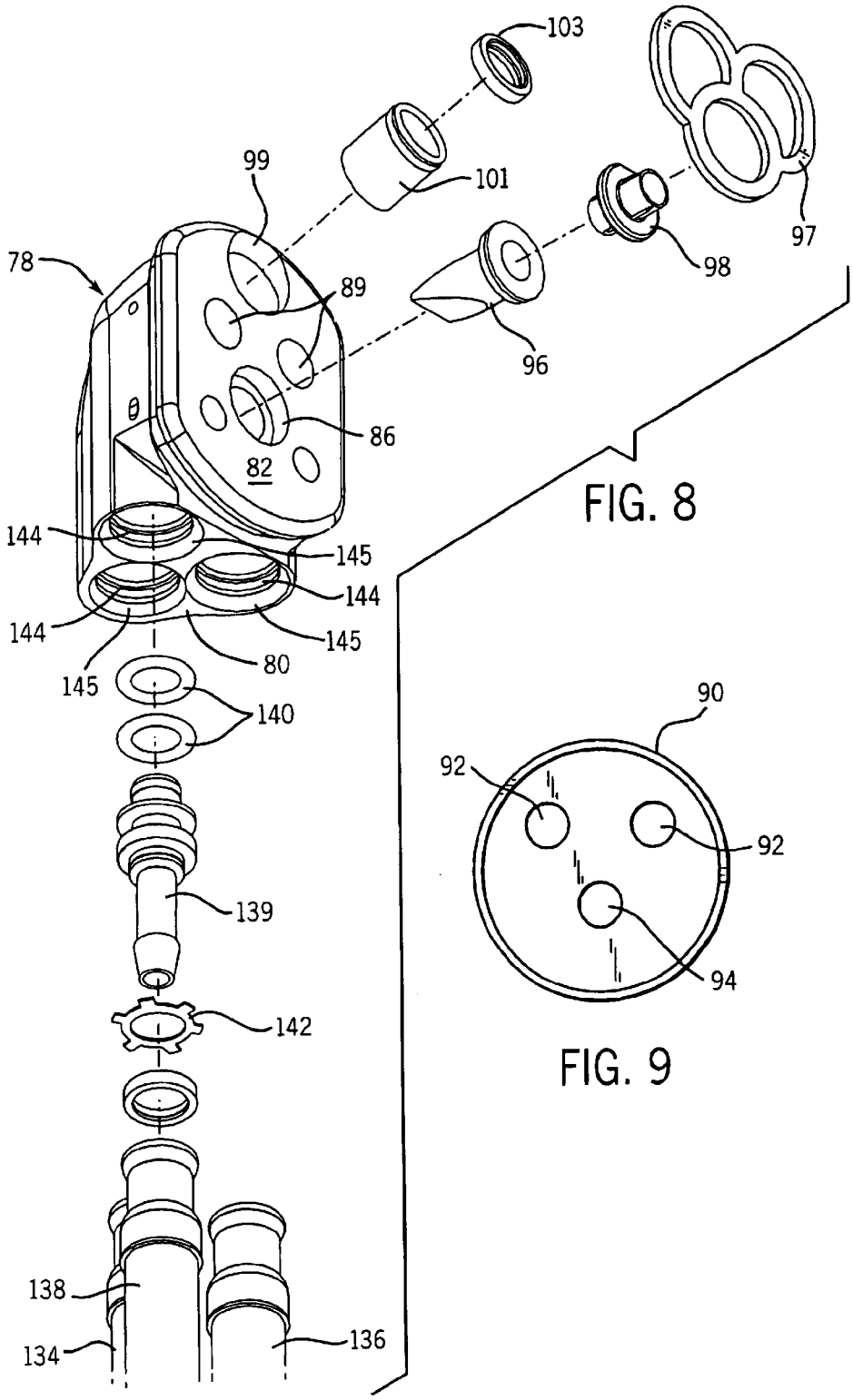
FIG. 8 is an exploded perspective view of a valve block portion of the assembly, and adjacent connectors.
FIG. 9 is an end view of a mixing valve useful with the faucet.

The body 18 is composed of four separate primary segments permanently joined together, as shown in FIG. 4, to form a single hollow body defining a longitudinal cavity 52 extending about a longitudinal faucet axis 53. There is a top end 48 and a bottom end 54 having external threads 56. The bottom end is designed to extend through an installation opening in a countertop (dotted lines in FIG. 4) and to mount an undercover 58 and a large escutcheon 60 (or alternatively a small escutcheon 62 and a rubber gasket 63) as well as fiber 64 and metal 66 washers and a brass retaining ring 68 which threads onto the bottom end and has threaded bores for bolts 70 to tighten against the metal washer.

The body also includes a sideways extending cylindrical section 72 defining a side opening 74 in communication with and extending laterally substantially perpendicular to the cavity. Importantly, the cylindrical section is internally threaded and has an inwardly directed lip 76 at its inner end that is used to mount the valve assembly as will now be described.

Referring next to FIGS. 3, 5, 8 and 9, the valve assembly includes a right-angle valve block 78 with a bottom face 80 and a perpendicular side face 82. The valve block has a pair of inlet passages 84 and an outlet passage 86 extending through the valve block and opening at both faces.

The valve block is retained from passing through the body cavity by engagement of a peripheral flange 88 and the lip 76 at the side opening. The rectilinear shape of the valve block prevents it from rotating within the body. A mixing valve cartridge 90 lies inside the cavity in a lateral orientation so that its two inlet openings 92 and one discharge opening 94 align with the respective inlet and outlet passages of the valve block.

A three-hole rubber seal 97 is disposed between the side face of the valve block and the back of the mixing valve to seal the passages. The outlet passage contains a rubber duck-bill valve 96 and a retainer 98. An additional passage 99 in the valve block in communication with the outlet passage, includes a normally closed check valve 101 positioned by a retaining ring 103 (see FIG. 8). The check valve opens to the atmosphere only in the event of negative pressure in one of the hoses to prevent reverse flow.

The mixing valve is a self-contained cartridge containing standard internal components to regulate the temperature and flow rate of water coming out of the spray head. The mixing valve is controlled by a valve stem 100, which in this case extends laterally outside the body. A valve stem has a threaded bore 102 in which a bolt 104 threads to secure onto the stem a plastic adapter 106 that takes up any looseness between the stem and a brass stem adapter 108. The stem adapter 108 has an enlarged section 110 (that fits over the plastic adapter 106) with opposite flats 112 and it has a narrowed section 114 with opposite flats 116 at 90 degrees from flats 112.

The mixing valve also preferably has a fixed tab member 118 that can be engaged by an indexer ring (not shown) that rides on a rotatable splined section 120 to limit rotation of the stem and thereby, if desired, set a maximum temperature for the outgoing water.

The mixing valve is secured in the body by an externally threaded valve bonnet 122 that threads into the cylindrical section of the body. The threaded valve bonnet obviates dedicated fasteners for mounting the mixing valve and when tightened not only secures the mixing valve and the valve block but also compresses the three-holed seal between the side face of the valve block and the back (or bottom) of the mixing valve to ensure a water tight seal. A split ring 124 snaps onto the valve bonnet 122. A bushing 126 snaps into handle bonnet 128 and the combination snaps onto the split ring to conceal the valve. The flats of the stem adapter 108 and the bushing mate so that the handle bonnet (with ring 124) rotates with the valve stem.

A lever-like handle 130 has an opening that fits onto the narrowed section of the stem adapter 108 and a set screw 132 threads against the stem adapter 108 to secure the handle to the valve stem. The handle (and valve stem) pivots in an up and down direction (accommodated by the elongated opening in the handle bonnet) to open and close the valve and rotates fore and aft to select warmer or cooler temperatures.

At the other end of the valve block, a pair of cold 134 and hot 136 water supply hoses couple to the ports of the inlet passages and a valve outlet hose 138 couples to the port of the outlet passage. Preferably, the spray hose and the valve outlet hose couple together. The supply and valve outlet hoses couple to the valve body by simply pushing their ends into the appropriate opening. An end of the water supply and valve outlet hoses can have a fitting 139 with a pair of O-rings 140 to seal the port, and a star washer 142 that snaps into a groove 144 at each port. Snapping the star washer into the groove is eased by a taper 145 at the face of the port. This configuration is a one-time permanent connection allowing manual or automated assembly of the hoses.

A hose guide 146 fits into the bottom end of the body to divide the opening essentially in two. Preferably, the water supply and valve outlet hoses are all on one side of the guide, leaving room for the spray hose on the other to run back up through the body and spout and connect to the spray head via the swivel connection mentioned above. The guide prevents the hoses from being tangled and ensures that the spray hose can slide freely into and through the body and spout as it is extended and retracted.

An annular weight 150 slides onto the spray hose and rests against the connection with the valve outlet hose. The weight works to bias the spray head toward the distal end of the spout and thereby tends to return the spray head to the retracted position (seated against the distal end of the spout).

The above described structure makes possible a very efficient assembly procedure. The three hoses can be installed into the valve block and then their free ends can be inserted through the side opening of the body and then fed down through its bottom opening. The valve block is inserted through the side opening until its flange abuts the narrowed lip. The valve cartridge and valve bonnet are then installed into the side opening and then the handle bonnet and handle are installed. The spray hose is then coupled to the valve outlet hose and fed back up through the body and spout and is connected to the spray head.

Thus, the invention provides a pull-out faucet in which the spray head is connected to water supply lines by a flexible hose disposed inside the faucet. This allows the faucet to look and operate like a conventional solid body faucet and also allow the spray head to be pulled out from the faucet. The faucet has a unique hollow body with a cylindrical opening in which is disposes a valve cartridge lying laterally so that its valve stem extends out from one side of the faucet for attaching a handle. The side opening permits easy installation of the hoses and valve assembly from above the sink.

It should be appreciated that a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

INDUSTRIAL APPLICABILITY

The invention provides a pull-out faucet.

I claim:

1. A pull-out faucet, comprising:

a hollow body defining a longitudinal cavity opening at a bottom end and at a top end and having a side opening;

a spout having proximal and distal ends and defining a passageway there between, the proximal end being mounted to the top end of the body;

a spray head having discharge orifices and being positioned adjacent the distal end of the spout when the spray head is in a retracted position;

a right angle valve block that is not integral with the hollow body, is disposed in the cavity, has a bottom face with ports in communication with two inlet passages and an outlet passage, has a side face with ports in communication with the inlet and outlet passages, and is sized so as to be able to be inserted through the side opening and at least partially into the longitudinal cavity so that the side face is essentially parallel with the side opening;

a mixing valve cartridge having an end that is positioned adjacent the side face of the valve block and having an opposite end with a control stem;

a valve bonnet disposed about the valve cartridge and mounted to the side opening;

water supply hoses coupled to the valve block inlet passages;

a spray hose having a first end coupled to the valve block outlet passage and a second end coupled to the spray head, the spray hose being of a suitable size to slide within the spout passageway to permit the spray head to be pulled from the spout between the retracted position and an extended position; and a handle coupled to the control stem for operating the valve cartridge.

2. The faucet of claim 1, wherein the side opening of the body is defined by a laterally extending cylindrical section having an inner end inside the cavity and an outer end outside the cavity.

3. The faucet of claim 1, wherein the valve block inlet passages open in the direction of the bottom opening in the body.

4. The faucet of claim 1, wherein one or more of the hoses is coupled to the valve block by a push-in connection, via a washer projection.

5. The faucet of claim 1, further comprising a counterweight mounted to the spray hose to bias the spray head towards the distal end of the spout.

6. The method of claim 1, further comprising mounting a handle bonnet about an end of the mixing valve cartridge.

7. The method of claim 1, further comprising mounting a counterweight to the spray hose to bias the spray head towards a distal end of the spout.

8. A pull-out faucet, comprising:

a hollow body defining a longitudinal cavity opening at a bottom end and at a top end and having internally a threaded side opening;

a spout having proximal and distal ends and defining a passageway there between, the proximal end being mounted to the top end of the body;

a spray head having discharge orifices and being positioned adjacent the distal end of the spout when the spray head is in a retracted position;

a valve block that is not integral with the hollow body, is disposed in the cavity, has two inlet passages, has an outlet passage, and has a side face;

a mixing valve cartridge having an end that is positioned adjacent the side face of the valve block and having an opposite end with a control stem;

an externally threaded valve bonnet disposed about the valve cartridge and threaded into the side opening;

water supply hoses coupled to the valve block inlet passages;

a spray hose having a first end coupled to the valve block outlet passage and a second end coupled to the spray head, the spray hose being of a suitable size to slide within the spout passageway to permit the spray head to be pulled from the spout between the retracted position and an extended position; and a handle coupled to the control stem for operating the valve cartridge;

wherein the side opening of the body is defined by a laterally extending cylindrical section having an inner end inside the cavity and an outer end outside the cavity; and wherein the inner end of the cylindrical section has an inwardly directed lip and the valve block has a peripheral flange that engages the lip to help limit movement of the valve block through the body.

9. The faucet of claim 8, wherein a handle bonnet is mounted about the control stem to the outer end of the cylindrical section to rotate with the control stem.

10. A pull-out faucet, comprising:

a hollow body defining a longitudinal cavity opening at a bottom end and at a top end and having internally a threaded side opening;

a spout having proximal and distal ends and defining a passageway there between, the proximal end being mounted to the top end of the body;

a spray head having discharge orifices and being positioned adjacent the distal end of the spout when the spray head is in a retracted position;

a valve block that is not integral with the hollow body, is disposed in the cavity, has two inlet passages, has an outlet passage, and has a side face;

a mixing valve cartridge having an end that is positioned adjacent the side face of the valve block and having an opposite end with a control stem;

an externally threaded valve bonnet disposed about the valve cartridge and threaded into the side opening;

water supply hoses coupled to the valve block inlet passages;

a spray hose having a first end coupled to the valve block outlet passage and a second end coupled to the spray head, the spray hose being of a suitable size to slide within the spout passageway to permit the spray head to be pulled from the spout between the retracted position and an extended position; and a handle coupled to the control stem for operating the valve cartridge;

wherein the spray head is coupled to the spray hose by a ball and socket connection.

11. A method of assembling a pull-out faucet, comprising the steps of:

providing a faucet body defining a longitudinal cavity opening at bottom and top ends and at a side opening between the bottom and top ends;

assembling hot and cold water supply lines to a valve block having bottom and top faces at essentially a right angle to each other, the hoses being connected to inlet ports at the bottom face and being in communication with associated ports at the side face of the valve block;

assembling a spray hose to an outlet port at the bottom face of the valve block to be in communication with an associated port at the side face;

inserting the hoses through the body side opening, then feeding them down through the body bottom opening;

inserting the valve block into the body side opening such that at least a portion of the valve block extends into the longitudinal cavity and the side face of the valve block is essentially parallel with the body side opening;

positioning a mixing valve cartridge against a the side face of the valve block so that corresponding ports of the mixing valve cartridge align with the side face ports;

mounting a valve bonnet to the body side opening;

feeding a first end of the spray hose up through the body bottom opening, through the cavity, through the body top opening, and into a spout attachable to the top end of the body; and coupling a spray head to the spray hose.

* * * * *